US011745155B2

(12) United States Patent
Oehring et al.

(10) Patent No.: US 11,745,155 B2
(45) Date of Patent: Sep. 5, 2023

(54) INDEPENDENT CONTROL OF AUGER AND HOPPER ASSEMBLY IN ELECTRIC BLENDER SYSTEM

(71) Applicant: U.S. Well Services, LLC, Houston, TX (US)

(72) Inventors: Jared Oehring, Houston, TX (US); Brandon N. Hinderliter, Houston, TX (US)

(73) Assignee: U.S. Well Services, LLC, Houston, TX (US)

( * ) Notice: Subject to any disclaimer, the term of this patent is extended or adjusted under 35 U.S.C. 154(b) by 153 days.

(21) Appl. No.: 17/484,818

(22) Filed: Sep. 24, 2021

(65) Prior Publication Data

US 2022/0008879 A1 Jan. 13, 2022

Related U.S. Application Data

(60) Division of application No. 16/356,263, filed on Mar. 18, 2019, which is a continuation of application No.
(Continued)

(51) Int. Cl.
*B01F 35/71* (2022.01)
*E21B 43/267* (2006.01)
(Continued)

(52) U.S. Cl.
CPC .... *B01F 35/71731* (2022.01); *B01F 35/3204* (2022.01); *B01F 35/32025* (2022.01);
(Continued)

(58) Field of Classification Search
CPC .. E04G 21/04; B28C 7/00; B28C 7/02; B28C 5/0875; B28C 9/04; B28C 7/0454;
(Continued)

(56) References Cited

U.S. PATENT DOCUMENTS 734,687 A * 7/1903 Erter ..... E01C 19/47 366/15
747,652 A * 12/1903 Schillinger ..... E01C 19/47 366/15
(Continued)

FOREIGN PATENT DOCUMENTS

WO WO-2007128931 A2 * 11/2007 ..... B28C 7/003
WO 2009046280 4/2009
(Continued)

OTHER PUBLICATIONS

Kroposki et al., Making Microgrids Work, 6 IEEE Power and Energy Mag. 40, 41 (2008).
(Continued)

*Primary Examiner* — Charles Cooley
(74) *Attorney, Agent, or Firm* — Hogan Lovells US LLP

(57) ABSTRACT

Embodiments relate to a hydraulic fracturing system that includes a blender unit. The system includes an auger and hopper assembly to receive proppant from a proppant source and feed the proppant to the blender unit for mixing with a fluid. A first power source is used to power the blender unit in order to mix the proppant with the fluid and prepare a fracturing slurry. A second power source independently powers the auger and hopper assembly in order to align the hopper of the auger and hopper assembly with a proppant feed from the proppant source. Thus, the auger and hopper assembly can be stowed or deployed without use of the first power source, which is the main power supply to the blender unit.

5 Claims, 7 Drawing Sheets

Related U.S. Application Data

15/294,349, filed on Oct. 14, 2016, now Pat. No. 10,232,332, which is a continuation-in-part of application No. 15/202,085, filed on Jul. 5, 2016, now Pat. No. 10,337,308, which is a continuation of application No. 13/679,689, filed on Nov. 16, 2012, now Pat. No. 9,410,410.

(60) Provisional application No. 62/242,657, filed on Oct. 16, 2015.

(51) Int. Cl.

| | |
|---|---|
| ***B28C 9/04*** | (2006.01) |
| ***B28C 7/04*** | (2006.01) |
| ***B28C 7/10*** | (2006.01) |
| ***F04B 17/03*** | (2006.01) |
| ***F04B 19/22*** | (2006.01) |
| ***F04B 49/20*** | (2006.01) |
| ***F04B 17/06*** | (2006.01) |
| ***F04B 23/00*** | (2006.01) |
| ***F04B 47/02*** | (2006.01) |
| ***F04B 49/06*** | (2006.01) |
| ***B01F 35/32*** | (2022.01) |
| ***E21B 43/26*** | (2006.01) |
| ***B01F 101/49*** | (2022.01) |

(52) U.S. Cl.

CPC ..... *B28C 7/0477* (2013.01); *B28C 7/10* (2013.01); *B28C 9/04* (2013.01); *E21B 43/267* (2013.01); *E21B 43/2607* (2020.05); *F04B 17/03* (2013.01); *F04B 17/06* (2013.01); *F04B 19/22* (2013.01); *F04B 23/00* (2013.01); *F04B 47/02* (2013.01); *F04B 49/065* (2013.01); *F04B 49/20* (2013.01); *B01F 2101/49* (2022.01)

(58) Field of Classification Search

CPC ..... B28C 7/044; B28C 9/0454; B28C 7/0418; B28C 7/0422; B28C 7/0477; B28C 7/10; B01F 15/0235; B01F 15/00538; B01F 15/00519; B01F 2215/0081; B01F 35/71731; B01F 35/32025; B01F 35/3204; B01F 2101/49; F01D 15/08; F01D 15/10; F02C 3/22; F04B 49/20; F04B 19/22; F04B 17/03; F04B 17/06; F04B 23/00; F04B 47/02; F04B 49/065; H02P 23/00; E21B 43/267; E21B 43/26; E21B 43/2607

USPC .... 366/14–20, 27–29, 33–35, 64–66, 37–38, 366/31–32, 50–51, 41

See application file for complete search history.

(56) References Cited

U.S. PATENT DOCUMENTS 821,790 A * 5/1906 Dorweiler ..... E01C 19/47 366/15
858,017 A * 6/1907 Pence ..... B28C 5/1246 366/35
921,480 A * 5/1909 Stevens et al. ..... B28C 5/1246 366/35
1,138,397 A * 5/1915 Nesetril ..... E01C 19/47 366/15
1,233,198 A * 7/1917 Davis ..... A01C 1/08 366/188
1,619,145 A * 3/1927 McMillan ..... E01C 19/47 366/15
2,017,439 A * 10/1935 Wentworth ..... E01C 19/47 366/35
2,104,191 A * 1/1938 Flynn ..... B28C 9/0454 366/291
2,139,027 A * 12/1938 McConnaughay ..... E01C 19/46 366/50
2,276,237 A * 3/1942 Lowry ..... B28C 5/1276 366/35
2,298,258 A * 10/1942 Ziler ..... B28C 9/0481 366/35
2,425,674 A * 8/1947 Fleischmann ..... B28C 5/4248 74/491
2,782,011 A * 2/1957 Fitzgerald ..... B65D 88/68 222/459
2,863,651 A * 12/1958 McBride ..... B01F 35/892 366/18
2,873,036 A * 2/1959 Noble ..... B28C 7/0486 414/520
2,929,658 A * 3/1960 Killebrew ..... B60P 1/6418 105/271
2,945,684 A * 7/1960 Soldini ..... B28C 7/0486 366/26
2,976,025 A * 3/1961 Pro ..... B28C 9/0427 366/26
3,050,159 A * 8/1962 Paulus ..... E01C 19/1009 366/9
3,064,832 A * 11/1962 Heltzel ..... B28C 7/0495 222/134
3,072,388 A * 1/1963 Ridley ..... B65D 90/623 366/65
3,251,484 A * 5/1966 Hagan ..... B28C 7/0495 414/21
3,305,222 A * 2/1967 Foster ..... B28C 9/00 366/35
3,343,688 A * 9/1967 Ross ..... B28C 7/049 366/18
3,451,659 A * 6/1969 Kriger ..... B01F 27/702 366/27
3,828,949 A * 8/1974 Spellman ..... B60P 1/36 366/43
3,967,815 A * 7/1976 Backus ..... B28C 9/00 366/141
4,185,923 A * 1/1980 Bouette ..... B28C 5/386 366/101
4,223,996 A * 9/1980 Mathis ..... B01F 35/71775 366/38
4,298,288 A * 11/1981 Weisbrod ..... B28C 9/0454 366/11
4,322,167 A * 3/1982 Hill ..... E01C 19/1068 366/14
4,375,335 A * 3/1983 Klein-Albenhausen ..... B01F 33/4092 366/132
4,411,313 A 10/1983 Johnson et al.
4,487,507 A * 12/1984 Van Wyngaarden ..... B09B 3/25 366/132
4,506,982 A * 3/1985 Smithers ..... B01F 33/502 366/65
4,538,916 A * 9/1985 Zimmerman ..... B28C 9/0463 366/186
4,548,507 A * 10/1985 Mathis ..... B28C 9/00 366/186
4,601,629 A 7/1986 Zimmerman
4,759,632 A * 7/1988 Horiuchi ..... E02D 15/06 366/51
4,768,884 A 9/1988 Elkin
4,922,463 A * 5/1990 Del Zotto ..... B28C 9/0463 366/186
5,044,819 A * 9/1991 Kilheffer ..... E01C 19/46 366/156.1
5,203,628 A * 4/1993 Hamm ..... B28C 9/0454 366/40
5,213,414 A * 5/1993 Richard ..... B28C 9/0409 366/38
5,486,047 A 1/1996 Zimmerman
5,570,953 A * 11/1996 DeWall ..... B28C 9/004 366/38

(56) References Cited

U.S. PATENT DOCUMENTS 5,573,333 A * 11/1996 Dahlman ..... B01F 35/2112 366/132
5,590,976 A * 1/1997 Kilheffer ..... G01G 19/08 366/8
5,624,183 A * 4/1997 Schuff ..... B28C 7/06 366/35
5,660,465 A * 8/1997 Mason ..... B01F 27/1143 366/15
5,775,803 A * 7/1998 Montgomery ..... B01F 35/8311 366/152.2
5,785,420 A * 7/1998 Schuff ..... B28C 5/142 366/35
5,813,455 A 9/1998 Pratt et al.
5,873,653 A * 2/1999 Paetzold ..... B01F 35/832 366/35
5,893,639 A * 4/1999 Tetoldini ..... B28C 9/0463 366/50
6,097,310 A 8/2000 Harrell et al.
6,224,250 B1 * 5/2001 Kreinheder ..... B28C 7/02 366/8
6,273,193 B1 8/2001 Hermann et al.
6,309,570 B1 * 10/2001 Fellabaum ..... B29C 48/38 264/102
6,442,942 B1 9/2002 Kopko
6,585,455 B1 7/2003 Petersen et al.
6,666,573 B2 * 12/2003 Grassi ..... B28C 7/12 366/26
6,808,303 B2 * 10/2004 Fisher ..... B28C 5/1246 366/26
6,832,851 B1 * 12/2004 von Wilcken ..... B28C 9/0481 366/26
6,876,904 B2 * 4/2005 Oberg ..... B28C 7/0418 700/265
6,955,311 B2 * 10/2005 Moro ..... B62D 55/06 241/101.8
9,140,105 B2 9/2015 Pattillo
9,353,593 B1 5/2016 Lu et al.
9,587,649 B2 * 3/2017 Oehring ..... H02K 9/04
9,731,255 B2 * 8/2017 Black ..... B28C 9/002
9,738,461 B2 * 8/2017 DeGaray ..... B28C 7/0038
9,745,840 B2 * 8/2017 Oehring ..... F04B 17/03
9,790,858 B2 10/2017 Kanebako
9,945,365 B2 4/2018 Hernandez et al.
10,232,332 B2 * 3/2019 Oehring ..... E21B 43/267
10,648,270 B2 5/2020 Brunty et al.
10,686,301 B2 6/2020 Oehring et al.
10,695,950 B2 * 6/2020 Igo ..... B28C 7/0422
10,731,561 B2 8/2020 Oehring et al.
10,767,561 B2 9/2020 Brady
10,781,752 B2 9/2020 Kikkawa et al.
10,988,998 B2 4/2021 Fischer et al.
2002/0169517 A1 * 11/2002 Hudelmaier ..... G06Q 10/06 700/213
2004/0045703 A1 3/2004 Hooper et al.
2004/0176876 A1 * 9/2004 Oberg ..... B28B 7/02 700/265
2006/0093536 A1 * 5/2006 Selby ..... B01F 27/70 422/224
2006/0201396 A1 * 9/2006 Smith ..... C04B 28/02 106/712
2007/0226089 A1 * 9/2007 DeGaray ..... G06Q 10/087 705/28
2007/0257392 A1 * 11/2007 Etherton ..... B01F 33/502 264/49
2008/0257449 A1 * 10/2008 Weinstein ..... B01F 33/502 141/231
2008/0273415 A1 * 11/2008 Thornton ..... B28C 9/002 366/8
2009/0177313 A1 * 7/2009 Heller ..... B28C 9/049 700/214
2009/0180348 A1 * 7/2009 Long, Jr. ..... B28C 9/0463 366/8
2010/0000442 A1 * 1/2010 Ackerman ..... C09D 195/00 106/277
2010/0127476 A1 * 5/2010 Gembala ..... B01F 25/45241 700/285
2011/0211418 A1 * 9/2011 Tassone ..... B01F 27/70 366/8
2012/0112757 A1 5/2012 Vrankovic et al.
2012/0205400 A1 * 8/2012 DeGaray ..... B28C 7/064 222/192
2013/0025706 A1 * 1/2013 DeGaray ..... B28C 7/0422 406/108
2013/0051971 A1 2/2013 Wyse et al.
2013/0199617 A1 * 8/2013 DeGaray ..... B28C 9/0454 137/1
2014/0174717 A1 6/2014 Broussard et al.
2014/0355372 A1 * 12/2014 Black ..... B28C 9/002 366/8
2016/0032703 A1 * 2/2016 Broussard ..... E21B 43/2607 166/250.01
2016/0107132 A1 * 4/2016 Igo ..... B28C 7/0422 366/8
2016/0136663 A1 * 5/2016 Smith ..... B28C 9/0454 427/230
2016/0208592 A1 * 7/2016 Oehring ..... E21B 43/2607
2016/0221220 A1 * 8/2016 Paige ..... B28C 9/0463
2016/0230660 A1 8/2016 Zeitoun et al.
2016/0273328 A1 * 9/2016 Oehring ..... E21B 43/2607
2016/0290114 A1 * 10/2016 Oehring ..... E21B 43/26
2016/0319650 A1 * 11/2016 Oehring ..... E21B 43/267
2017/0022788 A1 * 1/2017 Oehring ..... F04B 49/20
2017/0028368 A1 * 2/2017 Oehring ..... F04B 17/06
2017/0030177 A1 * 2/2017 Oehring ..... E21B 7/02
2017/0030178 A1 * 2/2017 Oehring ..... F04B 19/22
2017/0314380 A1 * 11/2017 Oehring ..... E21B 23/08
2017/0369258 A1 * 12/2017 DeGaray ..... B28C 7/0418
2018/0366950 A1 12/2018 Pedersen et al.
2020/0040878 A1 2/2020 Morris
2020/0047141 A1 * 2/2020 Oehring ..... F04B 47/02
2020/0325760 A1 10/2020 Markham
2020/0350790 A1 11/2020 Luft et al.
2021/0198994 A1 * 7/2021 Christinzio ..... B01F 35/71775

FOREIGN PATENT DOCUMENTS

WO 2014177346 11/2014
WO 2019210417 11/2019

OTHER PUBLICATIONS

Dan T. Ton & Merrill A. Smith, The U.S. Department of Energy's Microgrid Initiative, 25 The Electricity J. 84 (2012), pp. 84-94.
Non-Final Office Action issued in U.S. Appl. No. 16/871,328 dated Dec. 9, 2021.
Non-Final Office Action issued in U.S. Appl. No. 16/943,935 dated Oct. 21, 2021.
Non-Final Office Action issued in U.S. Appl. No. 16/564,186, dated Oct. 15, 2021.
Final Office Action issued in U.S. Appl. No. 16/356,263 dated Oct. 7, 2021.
Non-Final Office Action issued in U.S. Appl. No. 17/060,647 dated Sep. 20, 2021.
Non-Final Office Action issued in U.S. Appl. No. 16/901,774 dated Sep. 14, 2021.
Canadian Office Action issued in Canadian Application No. 3,094,768 dated Oct. 28, 2021.

* cited by examiner

INDEPENDENT CONTROL OF AUGER AND HOPPER ASSEMBLY IN ELECTRIC BLENDER SYSTEM

CROSS REFERENCE TO RELATED APPLICATIONS

This application is a divisional of U.S. patent application Ser. No. 16/356,263, filed Mar. 18, 2019, which is a continuation of U.S. patent application Ser. No. 15/294,349, filed Oct. 14, 2016, now U.S. Pat. No. 10,232,332, issued Mar. 19, 2019, which claims priority to U.S. Provisional Application Ser. No. 62/242,657, filed Oct. 16, 2015, and is a continuation-in-part of and claims priority to and the benefit of U.S. patent application Ser. No. 15/202,085, filed Jul. 5, 2016, now U.S. Pat. No. 10,337,308, issued Jul. 2, 2019, which claims priority to and the benefit of Ser. No. 13/679,689, filed Nov. 16, 2012, now U.S. Pat. No. 9,410,410, issued Aug. 9, 2016; the full disclosures of which are hereby incorporated by reference herein for all purposes.

BACKGROUND OF THE INVENTION

1. Field of Invention

The present disclosure relates to operations in a subterranean formation. In particular, the present disclosure relates to a hydraulic fracturing system.

2. Description of Related Art

Hydraulic fracturing is a technique used to stimulate production from some hydrocarbon producing wells. The technique usually involves injecting fluid into a wellbore at a pressure sufficient to generate fissures in the formation surrounding the wellbore. Typically, the pressurized fluid is injected into a portion of the wellbore that is pressure isolated from the remaining length of the wellbore so that fracturing is limited to a designated portion of the formation. The fracturing fluid slurry, whose primary component is usually water, includes proppant (such as sand or ceramic) that migrate into the fractures with the fracturing fluid slurry and remain to prop open the fractures after pressure is no longer applied to the wellbore. Other than water, potential primary fluids for the slurry include nitrogen, carbon dioxide, foam (nitrogen and water), diesel, or other fluids. The fracturing slurry may also contain a small component of chemical additives, which can include scale build up inhibitors, friction reducing agents, viscosifiers, stabilizers, pH buffers, acids, biocides, and other fluid treatments. In embodiments, the chemical additives comprise less than 1% of the fracturing slurry.

The fluids are blended with a proppant in the blender unit. The proppant is supplied from a nearby proppant source via a conveyor into a hopper associated with the blender unit. The hopper associated with the blender unit can be difficult to align with the proppant feed. This difficulty arises, in part, because during transport on a trailer, the hopper of the blender unit is typically placed in a raised position. In order to properly position the hopper relative to the conveyor, so that the hopper can receive proppant, three steps are necessary, including 1) the trailer carrying the blender unit must be aligned with the conveyor, 2) power must be connected to the blender unit, and 3) the hopper must be lowered into position to receive proppant from the conveyor.

The problem lies in the necessary order of these three steps in known systems. For example, typically, power to the blender unit is not connected until all trailers and equipment are in place at the well site. Because the hopper cannot be lowered into position until power is connected to the blender unit, this means that the blender unit trailer must be positioned relative to the conveyor while the hopper unit is in the elevated position. The problem with this is that when in the hopper is in the elevated position, it is very difficult to tell when the trailer is properly aligned with the conveyor. Furthermore, by the time power is connected, allowing the hopper to be lowered, it is too late to reposition the blender unit trailer if the hopper does not properly align with the conveyor.

SUMMARY OF THE INVENTION

Disclosed herein are embodiment systems and methods of hydraulic fracturing with independent control of an auger and hopper assembly. In embodiments, a hydraulic fracturing system includes a blender unit capable of mixing proppant and fluid. A first power supply, such as an electric generator, can be used to power the blender unit. The system can further include an auger and hopper assembly, which includes one or more augers, a hopper, and a hydraulic cylinder. The hopper can receive proppant through an upper opening and transport the proppant out of the hopper using one or more augers. The hydraulic cylinder, when activated by one or more actuators for example, can move the auger and hopper assembly between a stowed position and a deployed position.

A second power supply, such as a battery, can power the auger and hopper assembly. The second power supply can operate independently of the first power supply. In other words, in embodiments, the battery can supply power to the auger and hopper assembly with no power input from the electric generator. The battery, however, can be recharged by the electric generator when the electric generator is on. Thus, the first power supply can recharge the second power supply, but the second power supply operates independently when powering the auger and hopper assembly. In embodiments, the second power supply is a 12-volt direct current battery. In embodiments, one or more batteries are connected in parallel to form a power supply.

The hydraulic fracturing system can further include a blender tub positioned beneath the auger outlets. When the auger and hopper assembly is in the deployed position, the auger outlets become aligned with upper opening of the blender tub. That is, the approximate center of the blender tub can be positioned below the auger outlets when the auger and hopper assembly is in the deployed position.

Methods according to various embodiments can include positioning a blender unit near a proppant source. The blender unit can be mobile. For example, it can be positioned on a truck or trailer that includes various other components of a blender system, such as a blender tub with an upper opening, and an auger and hopper assembly with the hopper having an upper opening and the auger outlets being positioned above the center of the blender tub. An example method can further include deploying the auger and hopper assembly from a stowed position to a deployed position. When the assembly is in the deployed position, the hopper will be aligned with a proppant feed from the proppant source. For example, the proppant can be fracturing sand, and the proppant feed can be a sand conveyor configured to deliver sand to the hopper. Deploying the assembly, according to various embodiments, includes powering one or more actuators with a battery. In addition, the blender unit can be connected to a power supply, which is independent from the battery that powers the actuators of the auger and hopper assembly.

When the auger and hopper assembly is moved to the deployed position, proppant from the proppant feed can be received into the hopper through the upper opening of the hopper. One or more augers with inlets positioned to receive proppant from the hopper can move proppant out of the hopper. The auger outlets are positioned above the blender tub when the auger and hopper assembly is in the deployed position. Proppant from the hopper can then be released via the auger outlets into the blender tub, where it is received by the blending unit. The blending unit can then mix the proppant with a fluid to prepare a fracturing slurry. This slurry can be pumped to a fracturing pump system, where it can be highly pressurized and pumped into a subterranean formation, as discussed in more detail below.

BRIEF DESCRIPTION OF DRAWINGS

Some of the features and benefits of the present invention having been stated, others will become apparent as the description proceeds when taken in conjunction with the accompanying drawings, in which.

Figure 1:
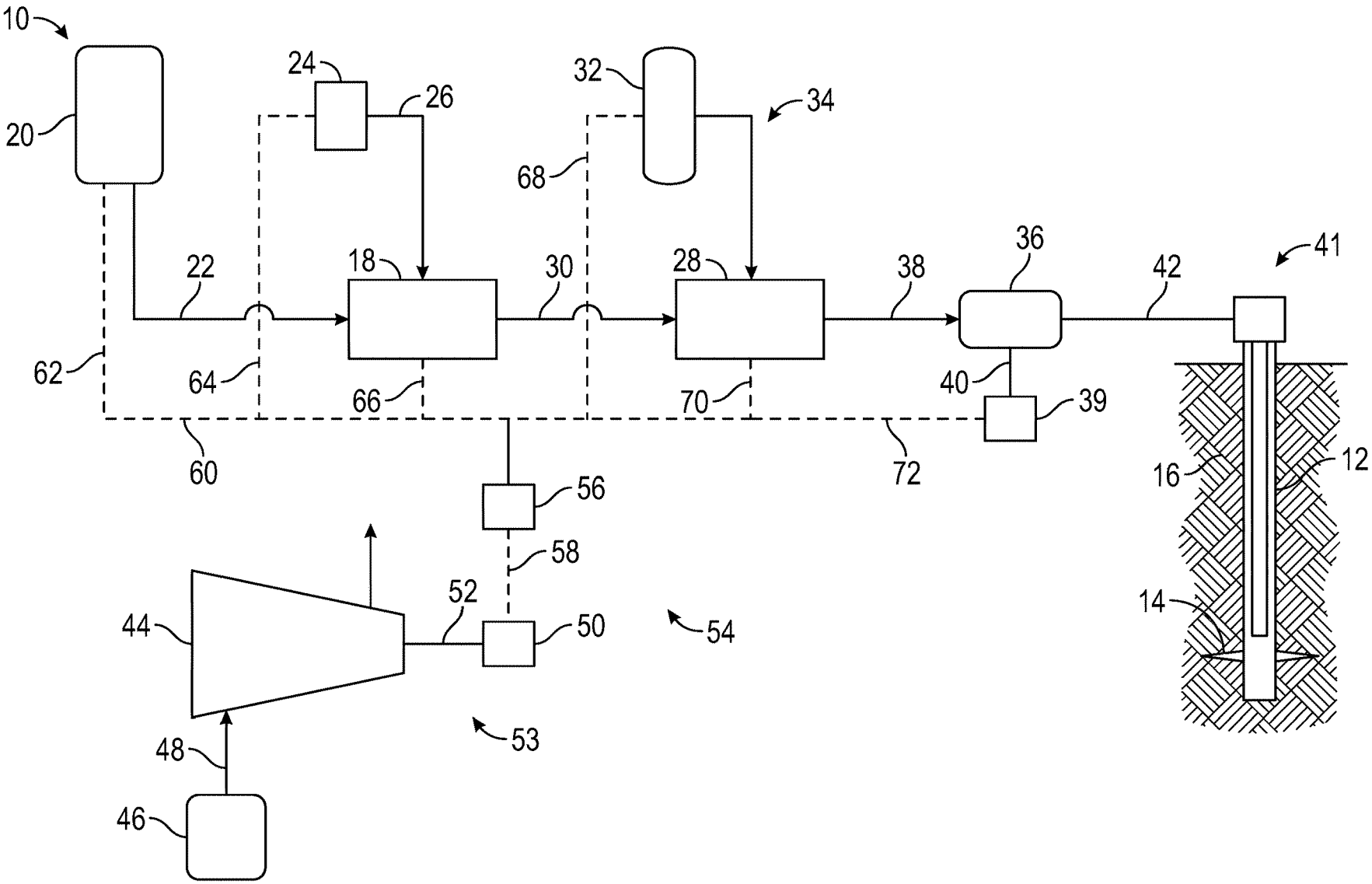
FIG. 1 is a schematic example of a hydraulic fracturing system according to certain embodiments.

While the invention will be described in connection with certain embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a schematic example of a hydraulic fracturing system 10 that is used for pressurizing a wellbore 12 to create fractures 14 in a subterranean formation 16 that surrounds the wellbore 12. Included with the system 10 is a hydration unit 18 that receives fluid from a fluid source 20 via line 22, and also selectively receives additives from an additive source 24 via line 26. Additive source 24 can be separate from the hydration unit 18 as a stand-alone unit, or can be included as part of the same unit as the hydration unit 18. The fluid, which in one example is water, is mixed inside of the hydration unit 18 with the additives. In an embodiment, the fluid and additives are mixed over a period of time to allow for uniform distribution of the additives within the fluid.

In the example of FIG. 1, the fluid and additive mixture is transferred to a blender unit 28 via line 30. A proppant source 32 contains proppant, which is delivered to the blender unit 28 as represented by line 34, where line 34 can be a conveyer. Inside the blender unit 28, the proppant and fluid/additive mixture are combined to form a fracturing slurry, which is then transferred to a fracturing pump system 36 via line 38; thus fluid in line 38 includes the discharge of blender unit 28 which is the suction (or boost) for the fracturing pump system 36. Blender unit 28 can have an onboard chemical additive system, such as with chemical pumps and augers. Optionally, additive source 24 can provide chemicals to blender unit 28; or a separate and stand-alone chemical additive system (not shown) can be provided for delivering chemicals to the blender unit 28. In an example, the pressure of the slurry in line 38 ranges from around 80 psi to around 100 psi. The pressure of the slurry can be increased up to around 15,000 psi by pump system 36.

A motor 39, which connects to pump system 36 via connection 40, drives pump system 36 so that it can pressurize the slurry. In one example, the motor 39 is controlled by a variable frequency drive ("VFD"). In one embodiment, a motor 39 may connect to a first pump system 36 via connection 40 and to a second pump system 36 via a second connection 40. After being discharged from pump system 36, slurry is pumped into a wellhead assembly 41; discharge piping 42 connects discharge of pump system 36 with wellhead assembly 41 and provides a conduit for the slurry between the pump system 36 and the wellhead assembly 41. In an alternative, hoses or other connections can be used to provide a conduit for the slurry between the pump system 36 and the wellhead assembly 41. Optionally, any type of fluid can be pressurized by the fracturing pump system 36 to form injection fracturing fluid that is then pumped into the wellbore 12 for fracturing the formation 14, and is not limited to fluids having chemicals or proppant.

An example of a turbine 44 is provided in the example of FIG. 1 and which receives a combustible fuel from a fuel source 46 via a feed line 48. In one example, the combustible fuel is natural gas, and the fuel source 46 can be a container of natural gas or a well (not shown) proximate the turbine 44. Combustion of the fuel in the turbine 44 in turn powers a generator 50 that produces electricity. Shaft 52 connects generator 50 to turbine 44. The combination of the turbine 44, generator 50, and shaft 52 define a turbine generator 53. In another example, gearing can also be used to connect the turbine 44 and generator 50.

An example of a micro-grid 54 is further illustrated in FIG. 1, and which distributes electricity generated by the turbine generator 53. Included with the micro-grid 54 is a transformer 56 for stepping down voltage of the electricity generated by the generator 50 to a voltage more compatible for use by electrical powered devices in the hydraulic fracturing system 10. In another example, the power generated by the turbine generator and the power utilized by the electrical powered devices in the hydraulic fracturing system 10 are of the same voltage, such as 4160 V so that main power transformers are not needed. In one embodiment, multiple 3500 kVA dry cast coil transformers are utilized. Electricity generated in generator 50 is conveyed to transformer 56 via line 58. In one example, transformer 56 steps the voltage down from 13.8 kV to around 600 V. Other step down voltages can include 4,160 V, 480 V, or other voltages. The output or low voltage side of the transformer 56 connects to a power bus 60. Lines 62, 64, 66, 68, 70, and 72 connect to power bus 60 and deliver electricity to electrically powered end users in the system 10. More specifically, line 62 connects fluid source 20 to bus 60, line 64 connects additive source 24 to bus 60, line 66 connects hydration unit 18 to bus 60, line 68 connects proppant source 32 to bus 60, line 70 connects blender unit 28 to bus 60. Another line can connect bus 60 to an optional variable frequency drive ("VFD") (not shown). The VFD can connect to motor 39. In one example, the VFD selectively provides electrical power to motor 39 via a dedicated or shared line, and can be used to control operation of motor 39, and thus also operation of pump 36.

In an example, additive source 24 contains ten or more chemical pumps for supplementing the existing chemical pumps on the hydration unit 18 and blender unit 28. Chemicals from the additive source 24 can be delivered via lines 26 to the hydration unit 18 and/or the blender unit 28. In certain embodiments, the elements of the system 10 are mobile and can be readily transported to a wellsite adjacent the wellbore 12, such as on trailers or other platforms equipped with wheels or tracks.

Figure 2:
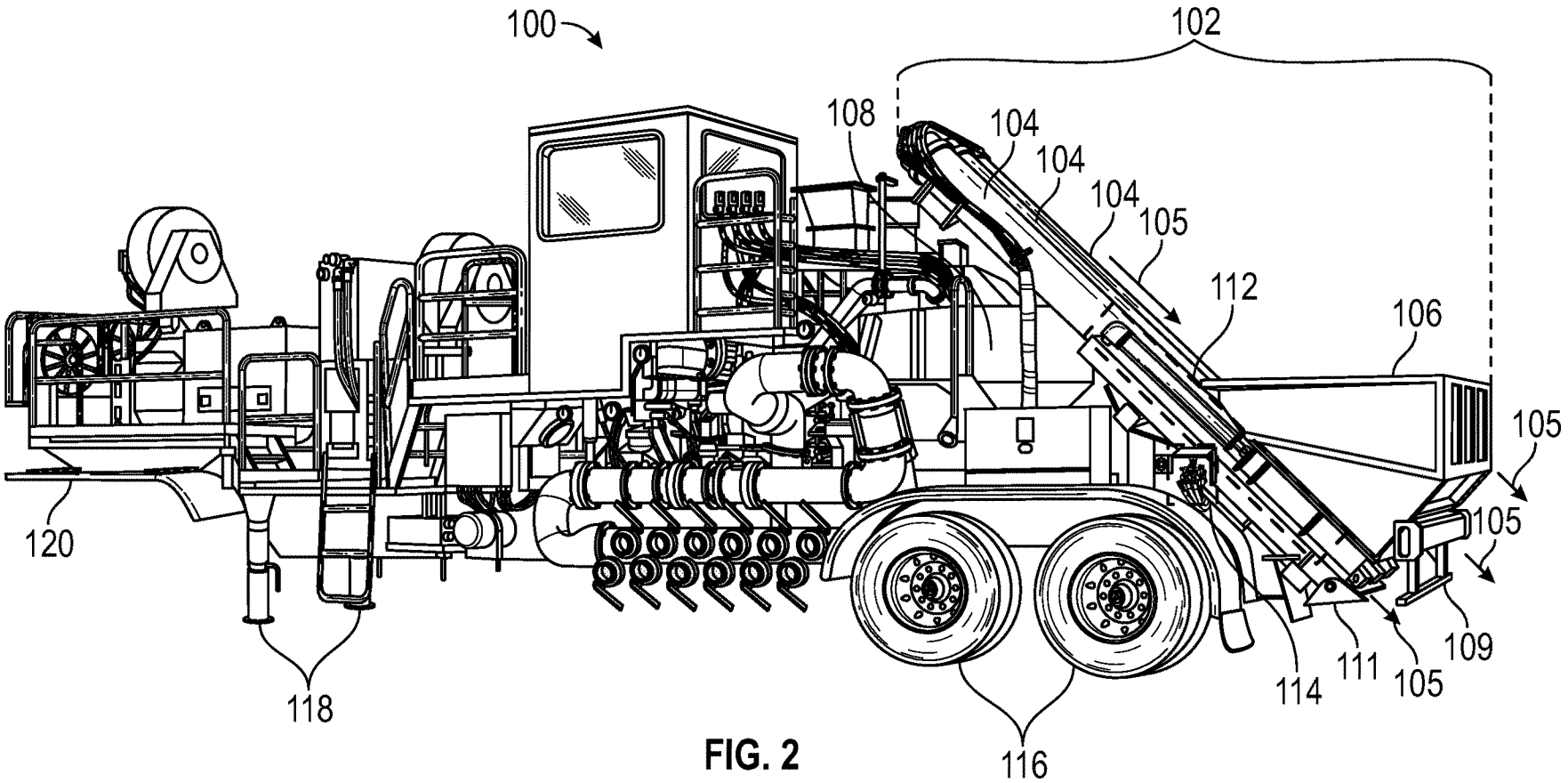
FIG. 2 is a side perspective view of a blender system with an auger and hopper assembly in a stowed position according to certain embodiments.
Figure 3:
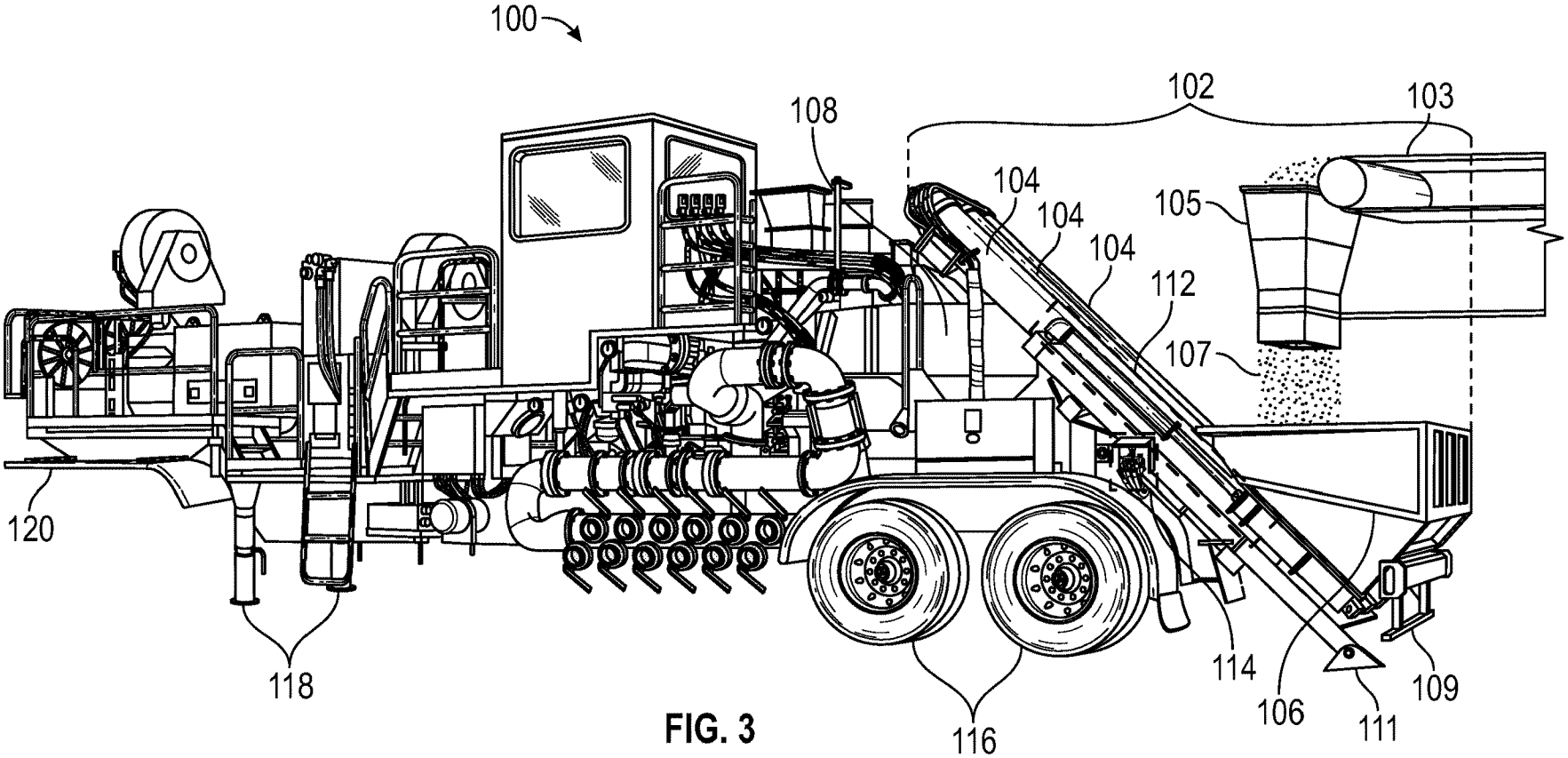
FIG. 3 is a side perspective view of a blender system with an auger and hopper assembly in a deployed position according to certain embodiments.

For example, the blender unit 28 can be positioned on a trailer, such as the exemplary trailer illustrated in FIG. 2 and FIG. 3. Thus, the blender unit 28 and various other components can comprise a blender system 100. The blender system 100 includes an auger and hopper assembly 102, which includes a hopper 106. The auger and hopper assembly 102 is capable of moving between a stowed position (FIG. 2) and a deployed position (FIG. 3). In embodiments, the stowed position is elevationally above the deployed position, and the auger and hopper assembly 102 can move between the two positions via an angled track 112, which is positioned between the augers 104 and the blender tub 108. Looking at FIG. 2 and FIG. 3 together, the auger and hopper assembly 102 can begin in the stowed position as shown in FIG. 2. The auger and hopper assembly 102 can be directed in the direction of the arrows 105 to reach its deployed position as shown in FIG. 3. A landing gear 111 can bear the weight of the hopper 106 when the auger and hopper assembly 102 is in the deployed position. In embodiments, the landing gear 111 comprises two support legs, one on each side of the hopper 106. A bumper 109 or safety guard can also be included to keep people or equipment from making contact with the exposed auger bearings.

The auger and hopper assembly 102 is typically placed in the stowed position during transport of the blender system 100. A hitch or other suitable coupling mechanism 120 can be provided on one end of the blender system 100 to facilitate transport. The blending system 100 can be towed to a desired location at an appropriate distance from a fracking site. In the illustrated embodiment, the blending system includes unpowered wheels 116 to facilitate towing and weight-bearing legs 118 to support the blending system 100 when the towing vehicle disengages. The legs 118 can be independently adjusted to allow an operator to level the blending system, or otherwise achieve a desired tilt, even while accounting for uneven ground. Although not required for operations, the blending system 100 can be isolated, i.e. no longer connected to a towing vehicle, due to space constraints in the field. Once in position, the blending system 100 is connected to micro-grid 54 or otherwise supplied with main electrical power. The main electrical unit powers the blender unit 28, enabling it to draw fluid onboard through a suction manifold and pump, and blend the proppant and fluid/additive mixture to form a fracturing slurry, which is then boosted to a fracturing pump system 36 through a discharge pump, as described more thoroughly with respect to FIG. 1.

In other words, main power is not provided to the blender system 100 until after the blender system 100 is initially staged. In some cases, it may take days from the time the equipment is staged before power is produced and directed to the blender system 100. Moreover, the blender system 100 is typically staged early in the process—before fracking pumps, iron, and sand equipment are positioned—so delays to staging the blender system 100 hold up other portions of the process. Further still, it is very difficult and dangerous to move equipment after power cables have been connected.

Main power is typically generated by diesel engines for diesel equipment or by an electric generator for electrically powered equipment. For electrically powered equipment, an electric generator may not arrive onsite until after the blender system 100 is in place, or the electric generator may be onsite, but not generating power until after the blender system 100 is in place. Thus, if positioning the auger and hopper assembly 102 of the blender system 100 rely exclusively on the main power, the auger and hopper assembly 102 cannot be raised or lowered into an ideal placement until the main electrical power is active and connected. In the event of a misalignment, the entire blender system 100 would need to be repositioned, which would be costly, time consuming, difficult, and sometimes dangerous.

Put another way, without an independent power supply for the auger and hopper assembly 102, the blender system 100 can be maneuvered into an incorrect position, but it will not be known that the hopper 106 is improperly aligned with the proppant feed until the entire blender system 100 is connected to a power supply, such as, for example, the micro-grid 54 discussed above. Once the misalignment is detected, the entire blender system 100 would have to be disconnected from the power supply in order to reposition the blender system 100. This process may even have to be iterated multiple times given the difficulty of estimating whether the hopper 106 will be properly aligned with the conveyor belt (or appropriate proppant feed) when in the deployed position. These iterations may involve disconnecting the main power and moving other equipment to allow for maneuvering the blender system 100. This can cause hours or days of downtime. Thus prior to being transported to a wellsite, the auger and hopper assembly 102 are put into a stowed position, and remain in that position, until the main power is online. The main power stays online until the fracturing job is completed. Usually the deployed position of the auger and hopper assembly 102 is difficult to predict accurately because the equipment is initially positioned with the auger and hopper assembly 102 in the stowed position.

After the fracturing job is completed, a rig down process occurs in which equipment is removed from the site. The main power is disconnected before the blender system 100 is moved. If the auger and hopper assembly 102 is in the deployed position, the blender system 100 cannot be moved. That is, if operators disconnected the main power from the blender system 100 without stowing the auger and hopper assembly 102, and there was no independent power supply to the auger and hopper assembly 102, then the blender system 100 would be unmovable until main power was reconnected to the blender system for the sole purpose of stowing the auger and hopper assembly 102. This problem, among others, is addressed by the claimed embodiments, which allow for the auger and hopper assembly 102 to move between the stowed position and deployed position without the blender system 100 needing to be connected to the main power source.

Still referring to FIG. 2 and FIG. 3, the blender system 100 is mounted on a trailer. In this example, the blender is a fracturing blender having a capability of supplying 130 bbl/min, and it is designed to mix slurries for fracturing treatments. The slurries, which can be used in hydraulic fracturing, can also include water or other fluids. In various embodiments, the blender system 100 can be skid, truck, or trailer mounted, and can be used on or off-shore. The auger and hopper assembly 102 includes one or more obliquely angled augers 104 that lift proppant from an attached hopper 106, and deliver the proppant to a blender tub 108 as shown. The system is capable of handling a wide array of tasks associated with complex fracturing operations in harsh oil-field conditions; and is operable in temperature ranges of −4° F. (−20° C.) to 115° F. (46° C.). Embodiments of the unit include 10 inch diameter pipe and a total power rating of 1,400 BHP (minimum). In one example, the system pumps inhibited acid.

The blender system 100 includes an independently powered auger and hopper positioning system to raise and lower the auger and hopper assembly 102 prior to setting up the main electrical power. The positioning system controls 114 are used to adjust the position of the auger and hopper assembly 102. In embodiments, the power supply comprises a dedicated electric 12 VDC power supply. In one example, the positioning system includes one or more actuators for positioning the auger and hopper assembly 102. In embodiments, the actuators are powered by a 12 VDC power supply. The power supply provides power for a hydraulic pump. In embodiments, the hopper power supply is not in communication with the main electrical power. In embodiments, the battery powering the auger and hopper control system is charged by the main power supply when the main power is on. In an embodiment, the actuators include one or more electrical motors and associated linkages, where the motors provide hydraulic power to drive the hydraulic cylinders 5 (FIG. 4 and FIG. 5) and linkages with sufficient force for positioning the auger/hopper into a designated position and/or orientation. In FIG. 5, the cylinder 5 is in a retracted configuration, whereas in FIG. 4 the cylinder 5 is in an extended configuration. Alternatively, the actuators are hydraulically powered with hydraulic fluid pressurized by pumps that are powered by the 12 VDC power source.

As indicated above, when setting up a hydraulic fracturing site it is important to position the sand delivery system and the blender so that the sand enters the blender hopper 106 in roughly the center of the hopper. However, it can be difficult to visualize exactly where the auger and hopper assembly 102 will be in the deployed position. Compounding this problem is that, in various embodiments, there are two blenders. One serves as a primary blender, and the other serves as a back-up blender. The proppant feed—the chute on a sand conveyor belt, for example—needs to be able to reach both blenders, while leaving some room between the blenders for personnel and equipment, such as fluid hoses, chemical hoses, and other tools.

Embodiments of the method and system described herein position the blender system 100, lower the auger/hopper assembly 102, and align the hopper 106 with the sand conveyer and other sand equipment. The steps of aligning and positioning described herein are performed without power from the main power supply. In embodiments, the hydraulic lines for powering the auger/blender actuator are isolated from other hydraulic lines that deliver hydraulic fluid to different services or circuits, such as cooling fans, blower motors, chemical pumps, the blender's suction pump, valve actuators, and the auger motors for rotating the auger blade. Optionally, the hydraulic lines that power the auger/hopper actuator can share a same hydraulic tank as other hydraulic systems.

Figure 4:
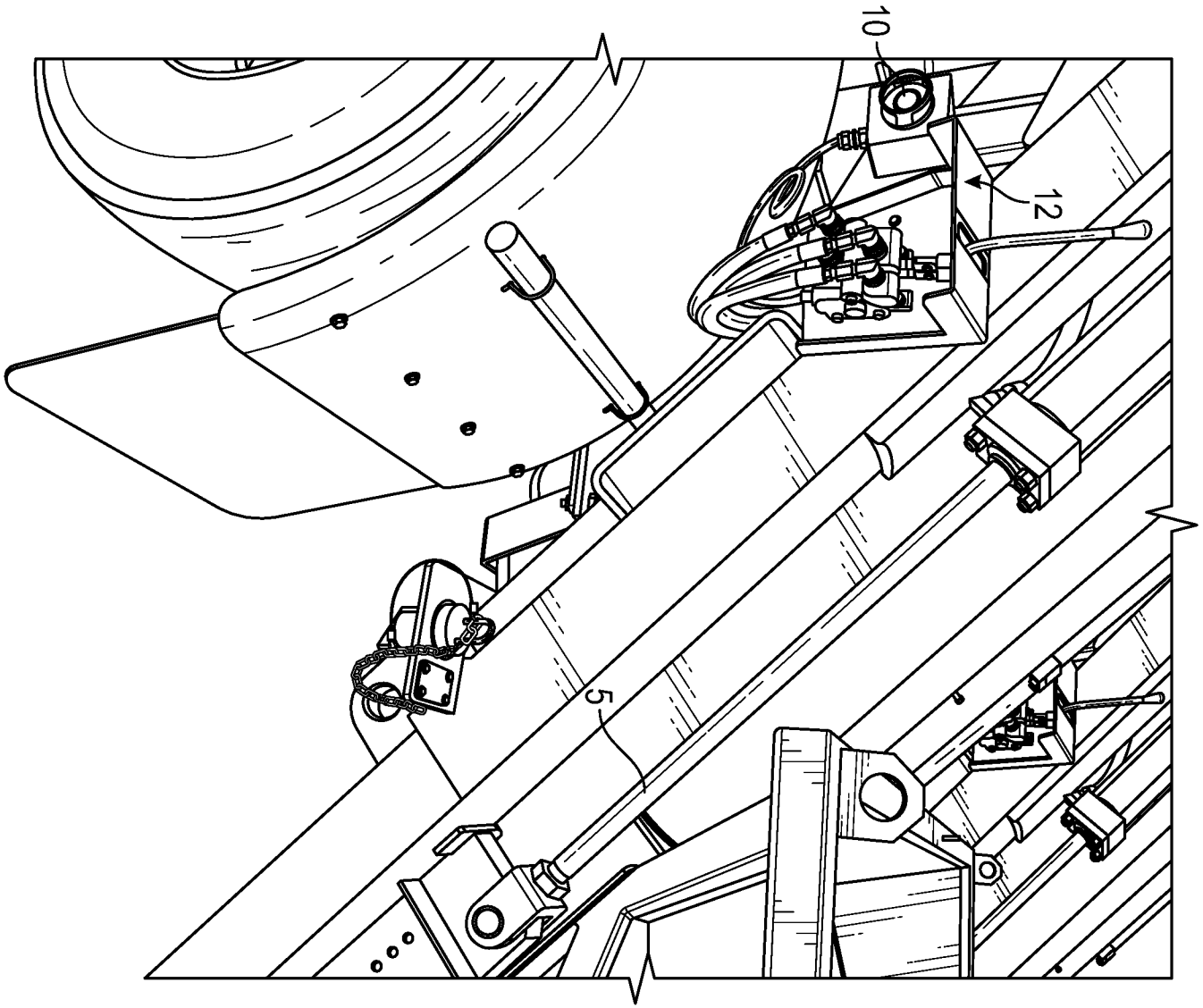
FIG. 4 is a view of a portion of a blender system with an auger and hopper assembly in a deployed position according to certain embodiments.
Figure 5:
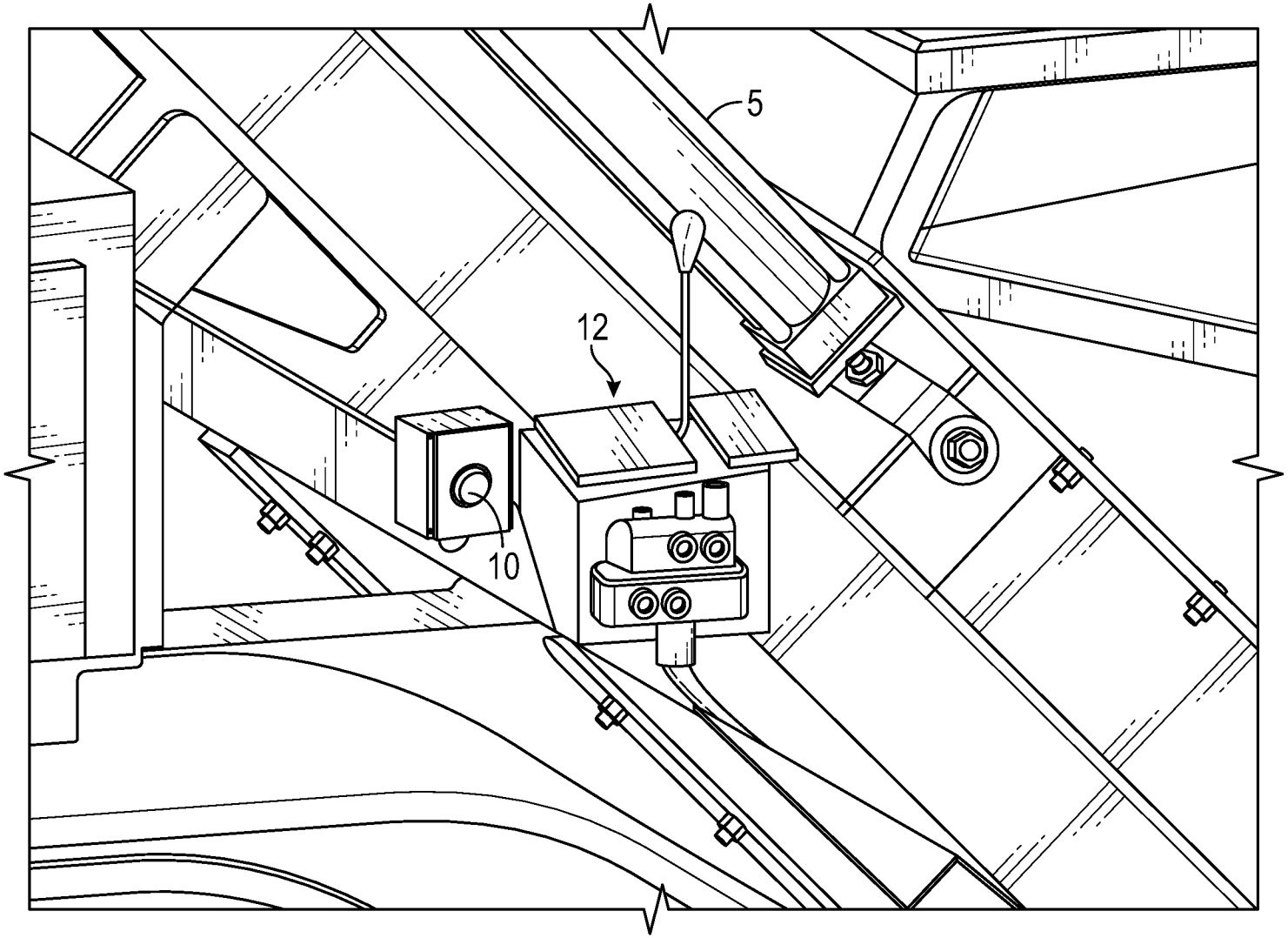
FIG. 5 is a view of a portion of a blender system with an auger and hopper assembly in a stowed position according to certain embodiments.
Figure 6:
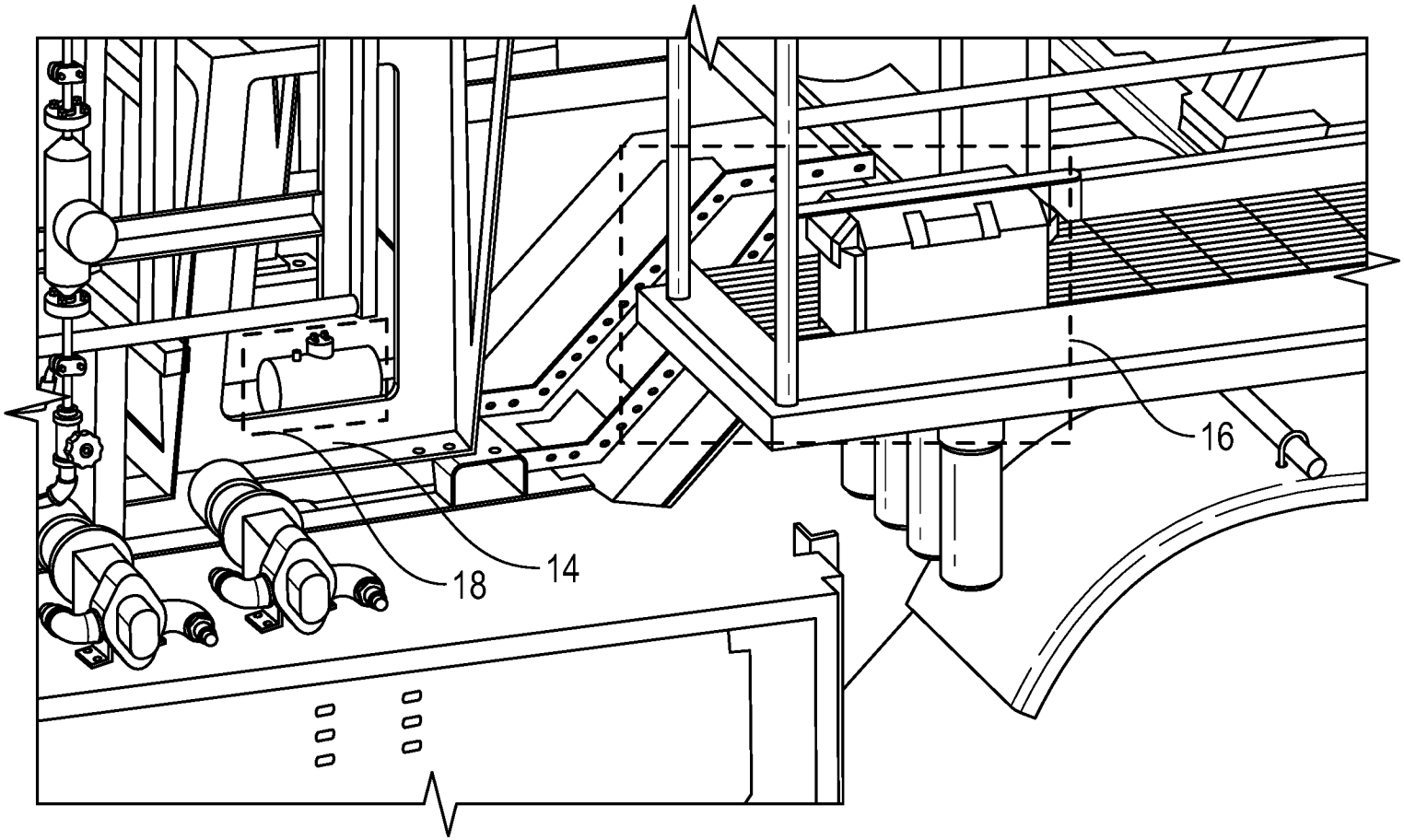
FIG. 6 is a view of a portion of a blender system according to certain embodiments.
Figure 7:
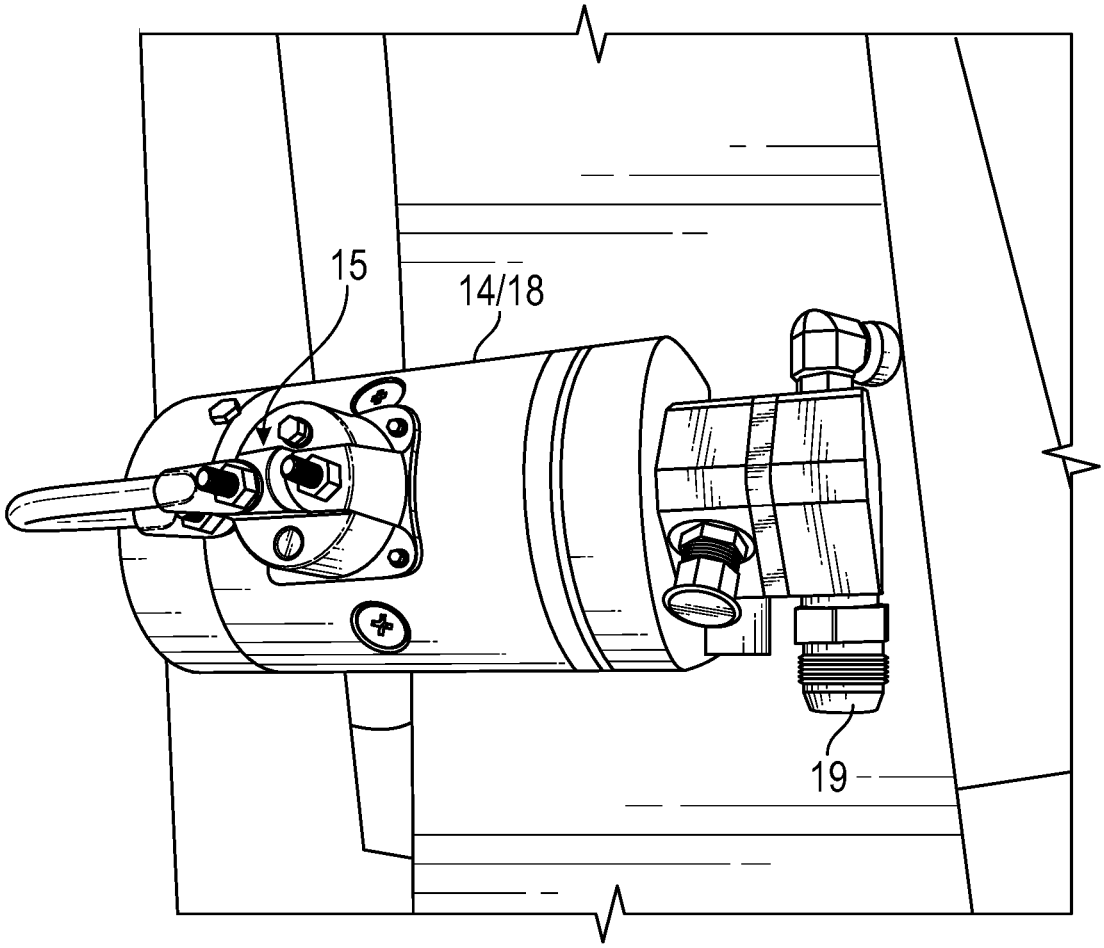
FIG. 7 is a view of a pump and motor assembly according to certain embodiments.

Referring now to FIG. 4, shown in a side perspective view is a portion of the auger and hopper assembly 102. A start button 10 can selectively energize a motor that drives a hydraulic pump, where the pump pressurizes hydraulic fluid for powering the actuators. Then the auger and hopper assembly 102 can be raised or lowered using a three-position valve 12. The three-position valve 12 can include positions for stowed, deployed, and closed. In certain embodiments, the stowed position can be labeled "up," and the deployed position can be labeled "down" on the valve 12. In the example of FIG. 4, the valve 12 is disposed in a hydraulic circuit and between the hydraulic pump and the actuators. Shown in perspective view in FIG. 6 is an example of a hydraulic pump 14 for pressurizing the hydraulic fluid used to actuate cylinder 5 (FIG. 5) into an extended position for selectively positioning the auger and hopper assembly 102. Further illustrated in FIG. 6 is a battery 16 that selectively provides electrical power to a motor 18 shown schematically coupled with the pump 14. The motor 18 and pump 14 are provided in a single unit in certain embodiments. FIG. 7 provides another view of this unit. Electrical connections 15 are provided to connect the motor 18 to the battery 16. Hydraulic connections 19 to the pump 14 are provided as well.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method comprising:

positioning a blender unit proximate to a proppant source, the blender unit disposed on a trailer that includes:

a blender tub with an upper opening, an auger and hopper assembly including (i) a hopper with an upper opening to receive proppant from the proppant source and (ii) an auger positioned outside the hopper, the auger having an inlet to receive proppant from the hopper and an outlet to selectively release proppant from the auger to the blender tub, and an auger and hopper power supply; and powering the auger and hopper assembly with the power supply to deploy the auger and hopper assembly from a stowed position to a deployed position, the deployed position being in alignment with a proppant feed from the proppant source.

2. The method of claim 1, further comprising:

connecting the blender unit to a blender unit power supply;

receiving, from the proppant feed, proppant into the hopper through the upper opening of the hopper;

transporting proppant from the auger inlet to the auger outlet;

releasing proppant from the auger outlet into the blender tub;

mixing the proppant in the blender tub with a fluid to prepare a fracturing slurry; and boosting the fracturing slurry to a fracturing pump system.

3. The method of claim 2, wherein the proppant comprises sand and the proppant feed comprises a chute associated with a sand conveyor.

4. The method of claim 2, wherein the blender unit power supply is an electric generator, the method further comprising:

recharging a battery with the electric generator.

5. The method of claim 4, the method further comprising:

combusting a fuel in a turbine to power the electric generator.

* * * * *